US007967236B2

(12) United States Patent
Jorkama et al.

(10) Patent No.: US 7,967,236 B2
(45) Date of Patent: Jun. 28, 2011

(54) ARRANGEMENT FOR ATTENUATING VIBRATION OF A ROLL ASSEMBLY

(75) Inventors: Marko Jorkama, Järvenpää (FI); Kimmo Penttilä, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 211 days.

(21) Appl. No.: 12/302,939

(22) PCT Filed: Jun. 11, 2007

(86) PCT No.: PCT/FI2007/050341
§ 371 (c)(1),
(2), (4) Date: Mar. 2, 2009

(87) PCT Pub. No.: WO2007/144466
PCT Pub. Date: Dec. 21, 2007

(65) Prior Publication Data

US 2009/0236465 A1 Sep. 24, 2009

(30) Foreign Application Priority Data

Jun. 12, 2006 (FI) ..... 20065399

(51) Int. Cl.
*B65H 75/18* (2006.01)

(52) U.S. Cl. ..... 242/599; 242/599.3; 242/599.4

(58) Field of Classification Search ..... 242/599, 242/599.3–599.4
See application file for complete search history.

(56) References Cited

U.S. PATENT DOCUMENTS

| | | | | |
|---|---|---|---|---|
| 2,974,894 | A | 3/1961 | Aaron | |
| 3,334,834 | A * | 8/1967 | Davidson et al. | 242/541 |
| 3,902,677 | A * | 9/1975 | Wolf | 242/542 |
| 5,909,855 | A | 6/1999 | Jorkama et al. | |
| 6,911,117 | B1 | 6/2005 | Karhunen et al. | |
| 7,588,208 | B2 * | 9/2009 | Stitz | 242/534 |

FOREIGN PATENT DOCUMENTS

| | | | |
|---|---|---|---|
| FI | 94458 | B | 5/1995 |
| FI | 101283 | B | 4/1998 |
| FI | 101320 | B | 5/1998 |
| JP | 63-267650 | A | 11/1988 |
| JP | 3-82843 | A | 4/1991 |
| WO | 2007/144466 | A1 | 12/2007 |

OTHER PUBLICATIONS

Written Opinion of the International Searching Authority issued in PCT/FI2007/050341.
International Preliminary Report on Patentability issued in PCT/FI2007/050341.

(Continued)

*Primary Examiner* — Sang Kim
(74) *Attorney, Agent, or Firm* — Stiennon & Stiennon

(57) ABSTRACT

An arrangement of attenuating the vibration in a roll assembly of a fiber web machine, in which assembly the roll (10) being rotatably suspended at its end on bearings in bearing housings (13*a*, 13*b*), and the bearing housings being supported on the frame or the foundation of the machine via viscoelastic intermediate piece or pieces (21*a*, 21*b*). The loss factor of the intermediate piece is greater than 0.1 at the normal operating conditions of the roll at a frequency range, which is ±10% calculated from the lowest bending eigenfrequency of the roll, and in the each end of the roll the spring constant of the total influence of the intermediate piece or pieces is in the range of 0.04 GN/m-1 GN/m.

7 Claims, 2 Drawing Sheets

OTHER PUBLICATIONS

Search Report issued in PCT/FI2007/050341.

Search Report issued in FI 20065399.

"Standard Test Method for Determination of Viscoelastic Properties of Elastomers using the Micro-Tribometer DIN 53 513", www.cetr.com, Jan. 14, 2005.

Notice of Opposition to European Patent No. 2027048 dated Nov. 4, 2010. This patent corresponds to FI20065399 which is the priority document for the above-referenced application.

Request for Documents dated Nov. 4, 2010; document requested: "Liste ausgelieferte Walzen".

Brief Communication dated Nov. 12, 2010.

Document D1.1 as cited in Notice of Opposition (German Translation of FI 94458).

Excerpts from Rotordynamik Book; Document D3 as cited in Notice of Opposition.

Document D3.1 as cited in Notice of Opposition.

Contitech Brochure; Document D4 as cited in Notice of Opposition.

* cited by examiner

ARRANGEMENT FOR ATTENUATING VIBRATION OF A ROLL ASSEMBLY

CROSS REFERENCES TO RELATED APPLICATIONS

This application is a U.S. national stage application of International App. No. PCT/FI2007/050341, filed Jun. 11, 2007, the disclosure of which is incorporated by reference herein, and claims priority on Finnish App. No. 20065399, filed Jun. 12, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement of attenuating the vibration in a roll assembly of a fiber web machine, in which assembly the roll being rotatably suspended at its end on bearings in bearing housings, and the bearing housings being supported on the frame or the foundation of the machine via viscoelastic intermediate piece or pieces.

With the increasing widths and speeds of paper and board machines the vibration of the rolls is becoming an increasingly severe problem.

At the end of a paper or a board machine, the web is wound to a so-called jumbo roll having the width of the machine. This jumbo roll is unwound and cut in a slitter winder to several strips which are then wound up to a so-called customer roll. Vibration is a problem particularly in two-drum or belt type winders. A vibration problem occurring with two-drum winders arises when the harmonics of rotational speed of the paper roll produced on drums excites the natural frequencies of the drums. The same type of a vibration problem occurs also with the reeling drums of reel-ups.

In general the resonance vibration during the operation of a machine or a device is caused by inadequate damping, in other words inadequate dynamic stiffness at the resonance frequency. The situation is often improved by modifying directly the resonating structure so that its damping is improved. For a general example, a free or a forced viscoelastic layer may be glued on top of a thin vibrating plate. Deformations of the plate then create deformations in the viscoelastic material having a high loss factor, whereby the damping of the eigenmode increases.

However, it is sometimes very difficult or impossible to change the resonating structure so that the damping could be improved. A small diameter paper machine roll resonating at its bending eigenmode can be mentioned as an example. The constrained viscoelastic layer attached to the roll shell does not increase significantly the dynamic stiffness at the lowest bending eigenfrequency because of the relatively high elastic energy of the thick roll shell. This type of arrangement does not induce large enough deformations in the viscoelastic layer due to the smallness of the deformations of the roll shell. Thus, the dynamic stiffness of the roll construction must be influenced some other way.

FI patent no. 94458 discloses a method and an apparatus for controlling the vibrations of paper machine rolls. According to the method, the locations of critical speed areas of the roll are changed during the operation. The critical speed is changed by adjusting the mass and/or the stiffness of the roll, and/or the suspension point of the roll. Amending the stiffness of the bearing support at the ends of the roll is suggested as an alternative. Intermediate pieces of elastic material may be placed between the base plate of housings of the end bearings and the frame. The stiffness of the suspension of the bearing housings can be adjusted by adjusting the force with which the bearing housing presses the intermediate pieces against the frame. This pressing force can be adjusted by a cylinder device or a screw.

JP patent publication no. 3082843 discloses an arrangement for attenuating vibrations of a roll. The drive motor of the roll is elastically attached to the frame. The attachment includes a vibration-proof intermediate piece of rubber between the bottom plate of the securing part of the drive motor and the frame. The securing bolts of the bottom plate extend through the frame plate to a cylinder fixed to the bottom surface of the frame plate where they are secured to a piston in the cylinder. There are rubber sleeves under the heads of the securing bolts; thus the attachment of the bottom plate is floating. In the inner surface of the cylinder there is an extension which limits the movement of the piston upwards in the cylinder. There is a spring between the cylinder top and the top of the piston, and a pressure space with pressurized air as the pressure medium between the bottom surface of the piston and the bottom of the cylinder. The piston is at first pushed pneumatically against the extension of the cylinder inner surface whereby the intermediate rubber pieces and the sleeves are subjected to a minimum pressing force. When the pressure of the compressed air under the piston is decreased the piston is moved downwards by the force of the spring above the piston whereby a greater compressing force is directed to intermediate rubber pieces and the rubber sleeves. Thus, the stiffness of the roll suspension can be regulated by means of the pressure medium under the piston.

These kind of arrangements are quite complex and require considerably sophisticated control system to operate. Thus, in practice they are somewhat prone to have disturbances in operation.

FI patent no. 101283 discloses a method in the winding of a paper web, which aims at avoiding vibration induced by the paper roll being wound-up by regulating the running speed of the winder. The running speed of the winder is adjusted based on the rotational speed of the paper roll being produced so that when the rotational speed of the paper roll being produced approaches the vibration range, the running speed is reduced so that the rotational speed of the paper roll being produced decreases to a range below the lower frequency of the vibration zone. Subsequently, the running speed of the winder is raised so that the rotational speed of the paper roll being produced remains constant until the initial running speed of the winder is reached.

This approach is not optimal for all circumstances and it is possible that occasionally potential capacity is lost due to unnecessary speed reductions.

SUMMARY OF THE INVENTION

It is an object of the invention to provide an arrangement of attenuating the vibration in a roll assembly of a fiber web machine which is straightforward and reliable in operation. The arrangement according to the present invention particularly contributes to reducing the vibration of a roll of a paper or a board machine.

In connection with this application the term "spring constant" should be understood as described in the following. The term spring constant is used for the tangent of the force-deflection curve. In the case of material with non-linear constitutive equation (i.e., strain-stress relation) the tangent is calculated at the current operating point with respect to the static pre-loading, frequency and temperature.

In connection with this application the term "loss factor" should be understood as described in the following. The term loss factor is used for the number, which is obtained when the tangent function applied to the phase angle between the loading and displacement in the principal direction of the movement when the applied loading is sinusoidal. The loss factor is also calculated at the current operating point with respect to the static pre-loading, frequency and temperature.

The method for determining the spring constant and loss factor for viscoelastic elastomers is presented in the standard DIN 53 513. This standard is also applicable in the circumstances of this invention, the only exception being the size of the specimen, which is now the intermediate piece.

In the arrangement of attenuating the vibration in a roll assembly of a fiber web machine according to the invention, the roll being rotatably suspended at its end on bearings in bearing housings, and the bearing housings being supported on the frame or the foundation of the machine via viscoelastic intermediate piece or pieces. The spring constant is selected based on the foundation so that elasticity of the support of the bearing needs to be within a particular range.

According to a preferred embodiment of the invention the problems of the prior art are solved so that in the each end of the roll the spring constant of the intermediate piece or pieces is depending on the structure and properties of the roll, its suspension and the foundation in particular manner. Advantageously the spring constant of the total influence of the intermediate piece or pieces in one side $k_f$ is in the range of 0.04 GN/m-1 GN/m, more advantageously 0.04 GN/m-0.5 GN/m.

Additionally, the loss factor of the intermediate piece is selected to be greater than 0.1 at the normal operating conditions of the roll at a frequency range, which is ±10% calculated from the lowest bending eigenfrequency of the roll. This way an adequate damping effect is achieved. The flexibility of the support of the bearing housing increases the relative movement of the bearing housing at the eigenfrequency in question and provides enhanced dynamical stiffness.

Thus, this way according to the invention the dynamic stiffness is increased by supporting the bearing housings of the roll on the frame or the foundation via flexible and damping intermediate pieces having its spring constant within this particular range. In practice often an applicable maximum value of the spring constant of the intermediate piece is 0.5 GN/m.

According to the arrangement of the invention, the damping capacity of an elastic weakly damped structure is improved so that damping is introduced into the structure via its suspension. Contrary to common practice, according to the invention this means arranging the suspension to be substantially flexible. Although the static stiffness of the structure and its suspension decreases, the dynamic stiffness of the structure itself increases. This is very important in connection with vibration of rotating machine parts.

The arrangement according to the invention is well applicable for example in a two-drum winder to attenuate the vibration of the drums, and for example in reel-ups to absorb the vibration of the reeling drums. The arrangement according to the invention has inter alia a benefit that it is applicable to all operating conditions once assembled without a need of continuous adjustment.

In the following the invention will be described with the reference to the accompanying schematic drawings.

DESCRIPTION OF THE PREFERRED EMBODIMENTS

Figure 1:
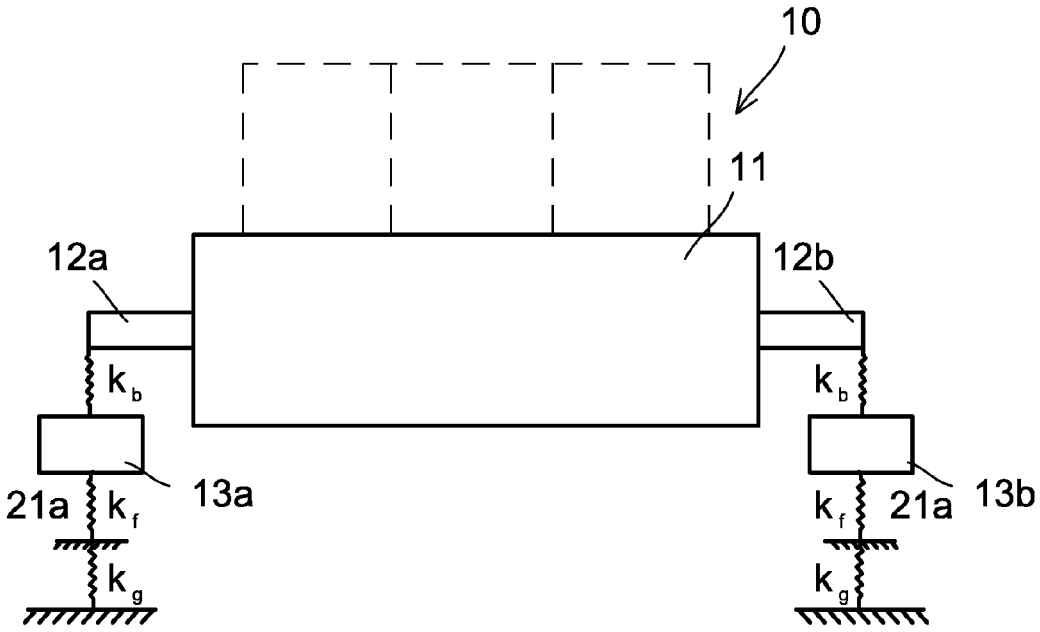
FIG. 1 illustrates a section of a roll illustrating the suspension to the foundation.

FIG. 1 is a schematic sectional illustration of a roll 10 to which the invention has been applied. There is also shown a set of paper rolls above the roll 10 with dotted line to illustrate that the roll is a drum of a two-drum winder. The roll 10 comprises a roll shell 11 with shaft journals 12*a*, 12*b* fixed at its ends. The roll 10 is supported via the shaft journals 12*a*, 12*b* on bearing housings 13*a*, 13*b*. When in use the roll 10 can rotate around its longitudinal axis in relation to the bearing housings 13*a*, 13*b*. The spring constant of the contact between the shaft journal 12*a*, 12*b* and the bearing housing 13*a*, 13*b* is denoted by parameter $k_b$. The spring constant of the foundation is denoted by $k_g$. Typically the spring constant $k_g$ is significantly higher than the other spring constants in the coupling shown in FIG. 1. The bearing housings 13*a*, 13*b* have been supported on the machine frame or foundation via a viscoelastic suspension, in other words via intermediate pieces 21*a*, 21*b* and the spring constant of this viscoelastic suspension is denoted by reference $k_f$. Now, according to the invention the spring constant $k_f$ of the intermediate piece is considerably small, that is, in the range from 0.04 GN/m to 1 GN/m. This way the dynamic stiffness of the whole structure is increased and its vibration in operational conditions is minimized.

In case the spring constant parameters mentioned above and the spring constant of the roll are defined for a particular case, the range of spring constant $k_f$ for that case may be defined also by using the following equation. Thus the range is $$\text{from } 0.5\cdot\frac{1}{\frac{2}{k_{roll}}-\frac{1}{k_b}-\frac{1}{k_g}} \text{ to } 5\cdot\frac{1}{\frac{2}{k_{roll}}-\frac{1}{k_b}-\frac{1}{k_g}}$$

As a practical example, a shell 11 width of the roll is 10 m, the outer diameter of the shell is 1 m, the inner diameter of the shell is 0.9 m, and the length a of the bearing journals is 150 mm. By adapting the modal measurements performed for the roll before the intermediate pieces according to the invention were installed to the structure, to the roll model according to FIG. 1, the following values are obtained for the suspension parameters.

$K^b$=1.87 GN/m $k_g$=15 GN/m

It should be noted that the spring coefficient of the foundation, $k_g$, is of clearly higher magnitude, and thus may be in practice often ignored in calculation of common effect of spring constants connected in series. The other parameters are:

$\eta_b$=0

$\eta_f$=0.087 in which $\eta_b$ is the loss factor of the contact between the shaft journal and the bearing housing, and $\eta_f$ is the loss factor between the bearing housing and the foundation.

The spring constant of the roll shell can be calculated by using the FEM calculation or for example a formula deducted from the Euler's beam model:

$$k_{roll} = \frac{48EI}{(12a^2 + 6al + l^2)l} \tag{2}$$

in which E is the modulus of elasticity, I is the moment of inertia, l is the length of the shell and the length of the bearing journals. The modulus of elasticity of steel is 200 kN/mm$^2$, and the moment of inertia I of the shell may be calculated from the formula $$I = \frac{\pi}{64}(D^4 - d^4) \tag{3}$$

By inserting the values D=1 m and d=0.9 m in the above formula (3), the following moment of inertia of the shell is obtained:

I=0.0169 m$^4$.

By inserting the values E=200 GN/m$^2$, I=0.0169 m$^4$, a=0.15 m and l=10 m in the above formula, the following spring constant of the roll shell is obtained:

$k_{roll}$=0.15 GN/m.

By inserting the values $k_{roll}$=0.15 GN/m, $k_b$=1.87 GN/m and $k_g$=15 GN/m in the range criteria of the range to be from $$0.5 \cdot \frac{2}{\frac{2}{k_{roll}} - \frac{1}{k_b} - \frac{1}{k_g}} \text{ to } 5 \cdot \frac{1}{\frac{2}{k_{roll}} - \frac{1}{k_b} - \frac{1}{k_g}}$$

the range of the spring constant $k_f$ will be 0.04 GN/m<$k_f$<0.4 GN/m. Thus, in this particular case the result is in a slightly narrower range than the general preferred range of 0.04 GN/m-1 GN/m according to the invention.

In practice the situation is usually not this simple, as it is possible to influence the total stiffness and the loss factor only to a limited extent. For example the suspension stiffness of the roll is formed by the individual stiffnesses of the shaft journal and the bearing housing, the bearing housing and the bed, and the foundation itself. In practice it is easiest to adjust the stiffness between the bearing housing and the foundation; thus this can be thought of as changing one spring of three springs in series.

Figure 2:
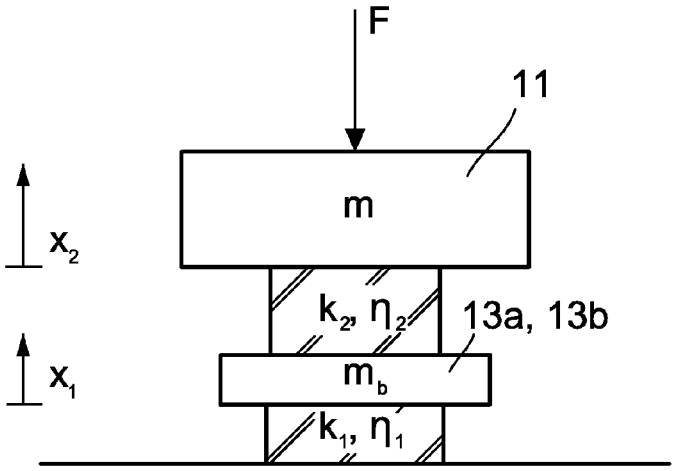
FIG. 2 illustrates a two degree of freedom model of a roll and its suspension.

Function and effects of the invention may be illustrated by the following in which the structure shown in FIG. 1 is reduced to a more simple model, shown in FIG. 2. FIG. 2 illustrates a two degree of freedom model of a roll and its suspension. The mass of the roll in the model correspond the total mass of the roll and is reduced at the center of the roll, and the suspension at the ends of the roll is reduced to a single model suspension. Thus the center of the roll shell 11 is depicted by the upper mass m which is later on called as the primary mass, and its movement or amplitude by reference $x_2$. The stiffness of the roll shell is depicted with a spring constant $k_2$ and the loss factor of the roll shell with a reference $\eta_2$. The mass of the bearing housings 12*a*, 12*b* is illustrated by the lower mass $m_b$ and the combined influence of the suspension is depicted by a spring constant $k_1$ and a loss factor by $\eta_1$. In FIG. 2 the spring constant $k_1$ is thus the combined effect of the spring constants $k_b$, $k_f$ and $k_g$ in the both ends of the roll illustrated in FIG. 1. The loss factor $\eta_1$ is also a combined effect of lost factors of foundation, bearing housing and intermediate pieces. The primary mass m is subjected to an external sinusoidal force F, which in practice may be caused by the force directed to the drum by the customer rolls.

The frequency response function of the primary mass m in the model illustrated in FIG. 2 is the following:

$$\left|\frac{x_2}{F}\right|(\omega) = \frac{1}{k_2}\left|\frac{k_1/k_2(1+i\eta_1)+1+i\eta_2-m_b/m(\omega/\omega_0)^2}{[1+i\eta_2-(\omega/\omega_0)^2]\left[\begin{matrix}k_1/k_2(1+i\eta_2)+1+\\ i\eta_2-m_b/(\omega/\omega_0)^2\end{matrix}\right]-(1+i\eta_2)^2}\right|$$

where

ω=angular frequency=2πf, in which f is the frequency $$\omega_0 = \sqrt{\frac{k_2}{m}}$$

Figure 3:
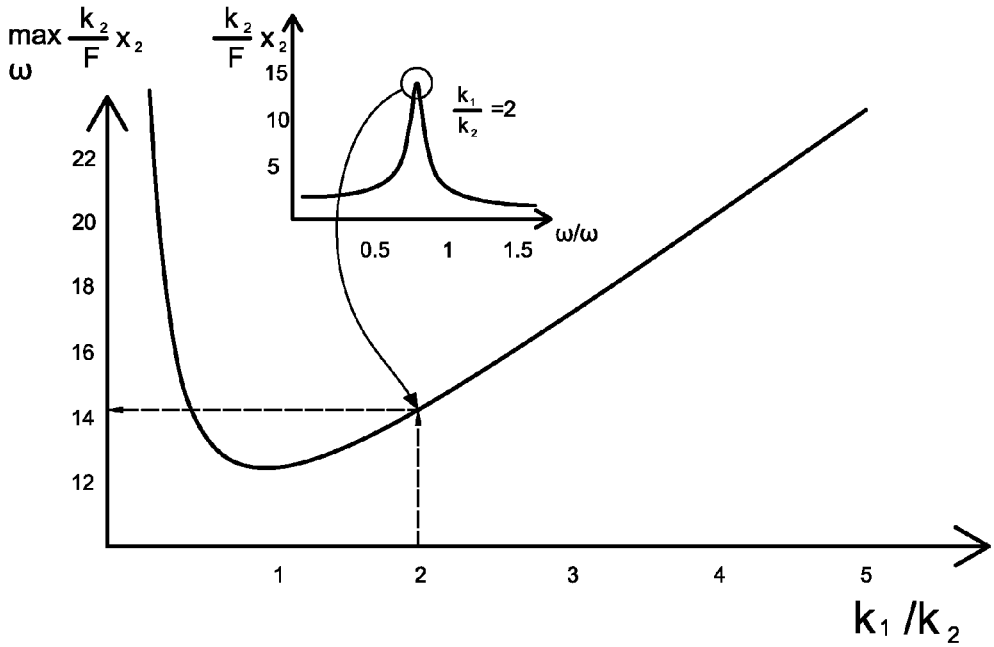
FIG. 3 illustrates the maximum of the frequency response function of a roll center as a function of the stiffness of the suspension of the roll.

When the maximum values of the frequency response function shown above at the lowest eigenfrequency are shown as a function of the stiffness ratio $k_1/k_2$, with the spring constant $k_1$ being dimensioned according to the invention, a curve depicted in FIG. 3 is obtained. The smaller figure in connection with FIG. 3 shows the frequency response function with the parameters $k_1/k_2$=2 resulting in a maximum value of about 14, which is pointed out the curve of FIG. 3 in order to make the presentation clear. In this example the values $m_b$/m=0.05, $\eta_1$=0.32 and $\eta_2$=0.001 have been used. The response increases rapidly when the stiffness $k_1$ of the suspension is reduced so that the stiffness ratio is decreased from value of about 0.5. Thus, about 0.5 is the practical lower limit. And, on the other hand the response increases also, but clearly more slowly, when the stiffness $k_1$ of the suspension ratio is increased so that the stiffness ratio is increased from the value of about 1.

In this presentation the spring constant $k_1$ is the combined effect of the spring constants $k_b$, $k_f$ and $k_g$ illustrated in FIG. 1. Thus it can be seen from the FIG. 3 that the presented range $$\text{from } 0.5 \text{ to } 5 \cdot \frac{1}{\frac{2}{k_{roll}} - \frac{1}{k_b} - \frac{1}{k_g}}$$

corresponding to range 0.5-4.3·$k_1/k_2$ results in very low response in a maximum values of the frequency response function indicating the benefits of the present invention.

So, in practice with a roll of a fiber web machine this leads to the value of the spring constant $k_f$ of the total influence of the intermediate piece or pieces in one side to be in the range from 0.04 GN/m to 1 GN/m. In case several distinct intermediate pieces are used in the coupling they may be installed in various manners connected in series and/or parallel and it is the total influence of all the intermediate pieces in the coupling that counts.

Thus according to the invention the parameters of the suspension are determined so that the dynamic stiffness of the roll is near the maximum value.

Figure 4:
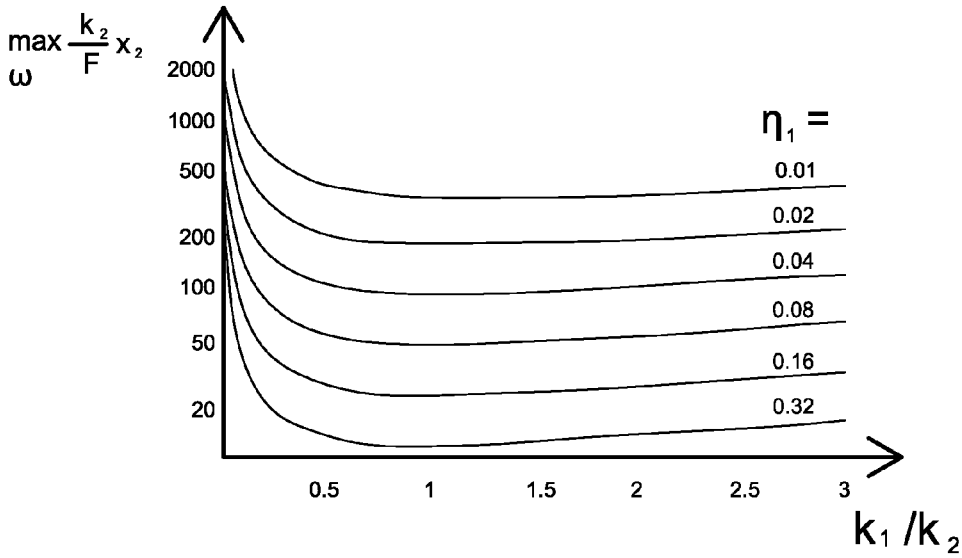
FIG. 4 illustrates the influence of the stiffness of the roll suspension and the loss factor on the frequency response function of the roll center.

FIG. 4 illustrates the influence of the loss factor $\eta_1$ of the suspension on the maximum of the frequency response function. The parameters used are the same as in FIG. 3. FIG. 4 shows that the influence of the loss factor $\eta_1$ is exponential. In other words, increasing the loss factor of the suspension by using viscoelastic material between the bearing housings and the frame or foundation increases efficiently the attenuating effect.

Based on the above, the dynamic stiffness of the roll 10 at the lowest bending eigemnode can be maximized by dimensioning the spring constant and the loss factor of the intermediate pieces 21*a*, 21*b* provided between the bearing housings 13*a*, 13*b* and the machine frame or the foundation in accordance with the invention.

In the case of the two-drum winder, the loading of the intermediate pieces varies for example due to the changes in the mass of the paper rolls but the influence of this is usually minimal compared with the loading caused by the securing screws of the bearing housings.

In addition to the intermediate pieces 21*a*, 21*b* between the bearing housings 13*a*, 13*b* and the frame, flexible (viscoelastic) washers must be provided also under the heads of the securing bolts of the bearing housings 13*a*, 13*b*. The sum of the spring constants of these and of the intermediate pieces to be provided under the housing is the spring the constant $k_f$.

Only a few preferred embodiments of the invention have been presented above and it is obvious to a person of ordinary skill in the art that numerous modifications may be made of if within the scope of protection defined by the appended patent claims.

We claim:

1. An apparatus for attenuating vibration in a roll assembly of a fiber web machine, comprising;

a roll in the roll assembly, the roll having a first end, a second end, and a lowest bending eigenfrequency;

a first bearing housing supported on a machine frame or foundation via at least one first viscoelastic intermediate piece, wherein the roll is rotatably suspended at the first end on a first bearing in the first bearing housing, and the first bearing housing being supported on the machine frame or foundation;

a second bearing housing supported on a machine frame or foundation via at least one second viscoelastic intermediate piece, wherein the roll is rotatably suspended at the second end on a second bearing in the second bearing housing, and the second bearing housing is supported on a machine frame or foundation;

wherein the at least one first viscoelastic intermediate piece, and the at least one second viscoelastic intermediate piece have loss factors of greater than 0.1 at a frequency range which is ±10% of the lowest bending eigenfrequency of the roll in normal operation;

wherein the at least one first viscoelastic intermediate piece has a spring constant in a range of 0.04 GN/m-1 GN/m;

wherein the at least one second viscoelastic intermediate piece have a spring constant in a range of 0.04 GN/m-1 GN/m;

wherein the roll has a spring constant $k_{roll}$;

wherein the first end of the roll defines a first shaft journal which contacts the first bearing to define a spring constant $k_b$ between the first shaft journal and the first bearing housing;

wherein the machine frame or foundation which supports the first bearing housing has a spring constant $k_g$; and wherein the spring constant of the at least one first viscoelastic intermediate piece $k_f$ is in the range:

$$\text{from } 0.5 \cdot \frac{1}{\frac{2}{k_{roll}} - \frac{1}{k_b} - \frac{1}{k_g}} \text{ to } 5 \cdot \frac{1}{\frac{2}{k_{roll}} - \frac{1}{k_b} - \frac{1}{k_g}},$$

wherein the second end of the roll defines a second shaft journal which contacts the second bearing to define a spring constant $k_b$ between the second shaft journal and the second bearing housing;

wherein the machine frame or foundation which supports the second bearing housing has a spring constant $k_g$; and wherein the spring constant of the at least one second viscoelastic intermediate piece $k_f$ is in the range:

$$\text{from } 0.5 \cdot \frac{1}{\frac{2}{k_{roll}} - \frac{1}{k_b} - \frac{1}{k_g}} \text{ to } 5 \cdot \frac{1}{\frac{2}{k_{roll}} - \frac{1}{k_b} - \frac{1}{k_g}},$$

where $k_{roll}$ is the spring constant of the roll, $k_b$ is the spring constant of the contact between the shaft journal and the bearing housing; and $k_g$ is the spring constant of the frame or foundation.

2. The apparatus of claim 1, wherein the at least one first viscoelastic intermediate piece comprises:

a plurality of distinct first viscoelastic intermediate pieces connected in series or parallel, said plurality of first distinct viscoelastic intermediate pieces having a total influence spring constant in a range of 0.04 GN/m-1 GN/m; and wherein the at least one second viscoelastic intermediate piece comprises:

a plurality of distinct second viscoelastic intermediate pieces connected in series or parallel, said plurality of distinct second viscoelastic intermediate pieces having a total influence spring constant in a range of 0.04 GN/m-1 GN/m.

3. The apparatus of claim 1, wherein the at least one first viscoelastic intermediate piece has a spring constant in a range of 0.04 GN/m-0.5 GN/m, and wherein the at least one second viscoelastic intermediate piece has a spring constant in a range of 0.04 GN/m-0.5 GN/m.

4. The apparatus of claim 1, wherein the roll is a drum of a winder of a paper or a board machine.

5. The apparatus of claim 1, wherein the roll is a reeling drum of a reel-up of a paper or a board machine.

6. A method of maximizing dynamic stiffness of a roll assembly of a fiber web machine, comprising the steps of:

selecting a roll in the roll assembly to have a first end, a second end, and a lowest bending eigenfrequency;

calculating a frequency range of a selected normal operating condition of a roll which is ±10% of a lowest bending eigenfrequency of the roll;

supporting a first bearing housing on a machine frame or foundation, such that the roll is rotatably suspended at the first end on a first bearing in the first bearing housing, and supporting the first bearing housing on at least one first viscoelastic intermediate piece on the machine frame or foundation;

supporting a second bearing housing on the machine frame or foundation, such that the roll is rotatably suspended at the second end on a second bearing in the second bearing housing, and supporting the second bearing housing on at least one second viscoelastic intermediate piece on the machine frame or foundation;

maximizing the dynamic stiffness of the roll assembly by dimensioning the first viscoelastic intermediary piece to have a loss factor greater than 0.1 within the calculated frequency range, and dimensioning the first viscoelastic intermediary piece to have a spring constant between 0.04 GN/m-1 GN/m;

maximizing the dynamic stiffness of the roll assembly by dimensioning the second viscoelastic intermediary piece to have a loss factor greater than 0.1 within the calculated frequency range, and dimensioning the second viscoelastic intermediary piece to have a spring constant between 0.04 GN/m-1 GN/m;

determining a spring constant $k_{roll}$ of the roll; and wherein the step of maximizing the dynamic stiffness of the roll assembly further comprises:

determining a spring constant $k_b$ between a first shaft journal at the first end of the roll and the first bearing;

determining a spring constant $k_g$ of the machine frame or foundation which supports the first bearing housing; and dimensioning the first viscoelastic intermediary piece to have a spring constant $$\text{between: } 0.5\cdot\frac{1}{\frac{2}{k_{roll}}-\frac{1}{k_b}-\frac{1}{k_g}} \text{ to } 5\cdot\frac{1}{\frac{2}{k_{roll}}-\frac{1}{k_b}-\frac{1}{k_g}},$$

determining a spring constant $k_b$ between a second shaft journal at the second end of the roll and the second bearing;

dimensioning the second viscoelastic intermediary piece to have a spring constant $$\text{between: } 0.5\cdot\frac{1}{\frac{2}{k_{roll}}-\frac{1}{k_b}-\frac{1}{k_g}} \text{ to } 5\cdot\frac{1}{\frac{2}{k_{roll}}-\frac{1}{k_b}-\frac{1}{k_g}},$$

7. A method of maximizing dynamic stiffness of a roll and roll suspension in a fiber web machine wherein the roll has two ends and the suspension includes two bearings to which the ends of the roll are mounted and a frame or foundation to which the bearings are mounted by way of intermediary viscoelastic pieces, the method comprising the steps of:

using the equation:

$$\left|\frac{x_2}{F}\right|(\omega)=\frac{1}{k_2}\left|\frac{k_1/k_2(1+i\eta_1)+1+i\eta_2-m_b/m(\omega/\omega_0)^2}{[1+i\eta_2-(\omega/\omega_0)^2]\begin{bmatrix}k_1/k_2(1+i\eta_2)+1+\\ i\eta_2-m_b/(\omega/\omega_0)^2\end{bmatrix}-(1+i\eta_2)^2}\right|$$

to search for maximum values of the equation with respect to ω for all values of $k_1$ and determining for which value of $k_1$ the maximum value is minimal;

wherein $k_2$ is a spring constant defined by the roll;

wherein $k_1$ is a spring constant defined by the roll suspension;

$\omega_0$ is the angular natural frequency (lowest bending angular frequency) of the roll;

ω is the angular frequency of the excitation force;

$\eta_1$ is the loss factor of the suspension which is greater than 0.1

$\eta_2$ is the loss factor of the roll;

m is the mass of the roll;

i is the imaginary unit, $\sqrt{-1}$;

$m_b$ is the mass of the bearings;

determining a spring constant $k_b$ between each roll end and each bearing;

determining a spring constant $k_g$ of the machine frame or foundation which supports each bearing housing; and dimensioning the first viscoelastic intermediary piece to have a spring constant of the determined value of $k_1$ for which the maximum value is minimal as adjusted for there being two bearings and the spring constant $k_b$ of the bearings and the spring constant of the frame or foundation $k_g$ in accord with the equation $$\frac{1}{\frac{2}{k_1}-\frac{1}{k_b}-\frac{1}{k_g}} \text{ times } a \text{ factor of } 0.5 \text{ to } 5.$$

* * * * *

UNITED STATES PATENT AND TRADEMARK OFFICE

CERTIFICATE OF CORRECTION

PATENT NO. : 7,967,236 B2
APPLICATION NO. : 12/302939
DATED : June 28, 2011
INVENTOR(S) : Jorkama et al.

It is certified that error appears in the above-identified patent and that said Letters Patent is hereby corrected as shown below:

Column 5, lines 31-35, " $0.5 \cdot \frac{2}{\frac{2}{k_{roll}} - \frac{1}{k_b} - \frac{1}{k_g}}$ to $5 \cdot \frac{1}{\frac{2}{k_{roll}} - \frac{1}{k_b} - \frac{1}{k_g}}$ " should be -- $0.5 \cdot \frac{1}{\frac{2}{k_{roll}} - \frac{1}{k_b} - \frac{1}{k_g}}$ to $5 \cdot \frac{1}{\frac{2}{k_{roll}} - \frac{1}{k_b} - \frac{1}{k_g}}$ --

Signed and Sealed this
Twenty-ninth Day of May, 2012

David J. Kappos

David J. Kappos
*Director of the United States Patent and Trademark Office*